US005086449A

United States Patent [19]

Furbee et al.

[11] Patent Number: 5,086,449

[45] Date of Patent: Feb. 4, 1992

[54] DEBUBBLER SYSTEM FOR X-RAY TUBES

[75] Inventors: Avery D. Furbee, Elmhurst; James E. Burke, Villa Park, both of Ill.

[73] Assignee: Picker International, Inc., Highland Hts., Ohio

[21] Appl. No.: 564,325

[22] Filed: Aug. 8, 1990

[51] Int. Cl.[5] ..... H01J 35/10

[52] U.S. Cl. ..... 378/200; 378/141; 378/199

[58] Field of Search ..... 378/199, 200, 201, 202, 378/127, 130, 141

[56] References Cited

U.S. PATENT DOCUMENTS

| | | | |
|---|---|---|---|
| 1,992,335 | 2/1935 | Tietig | 378/200 |
| 2,049,275 | 7/1936 | Simon | 378/200 |
| 4,115,697 | 9/1978 | Hounsfield | 378/199 |
| 4,651,338 | 3/1987 | Hahn | 378/200 |

FOREIGN PATENT DOCUMENTS

| | | | |
|---|---|---|---|
| 0892032 | 10/1953 | Fed. Rep. of Germany | 378/199 |
| 0617216 | 2/1949 | United Kingdom | 378/199 |

*Primary Examiner*—Janice A. Howell
*Assistant Examiner*—David P. Porta
*Attorney, Agent, or Firm*—Fay, Sharpe, Beall, Fagan, Minnich & McKee

[57] ABSTRACT

A coolant oil from an x-ray tube (14) is circulated through a heat exchanger (18) to reduce its temperature. More specifically, at least one hot coolant fluid receiving aperture (30) is defined adajcent an end of a suction tube 32) in an upper most portion of a horn portion (16) surrounding a cathode termination assembly. Bubblers (42) of gas in the fluid which could be ionized by electrical fields inside the x-ray tube housing causing x-ray tube current irregularities and corresponding x-ray tube output irregularities are drawn into the suction tube aperture. A debubbler (38) removes bubbles from the cooled coolant fluid before it is returned into an anode horn portion (20) of the x-ray tube. Alternately, the bubbles may be reabsorbed, dissolved, or homogenized by the action of the heat exchanger and pump. The coolant fluid passes through a central portion (24) of the x-ray tube absorbing heat and back to the cathode horn portion.

16 Claims, 3 Drawing Sheets

DEBUBBLER SYSTEM FOR X-RAY TUBES

BACKGROUND OF THE INVENTION

The present invention relates to the radiographic arts. It finds particular application in conjunction with x-ray tubes for use in computerized tomographic scanners and will be described with particular reference thereto. It is to be appreciated, however, that the present invention will also find utility in other applications, particularly those which are sensitive to even small variations in x-ray tube output.

In CT scanners, like other radiographic equipment, the product of the x-ray flux or output and the exposure time determines the dose of radiation passing through the patient. To increase the speed of CT scanners, hence reduce the time which the x-ray beam irradiates or exposes each radiation detector before sampling, progressively more powerful x-ray tubes have been developed. As this exposure time becomes shorter, the sampled data becomes more sensitive to fluctuations in the x-ray output of the tube.

Commonly, high powered tube housings have a cylindrical central portion which houses a rotating anode x-ray tube and defines an x-ray output window. At opposite ends of the central cylinder, the x-ray housings have enlarged portions or horns. The anode lead wire is connected within one horn and the cathode lead is connected within the other horn.

To electrically insulate the tube and its associated electrical connectors and to remove the large amounts of heat generated by these x-ray tubes, the horns as well as other regions of the housing are filled with a dielectric or oil coolant. Oil is commonly drawn through an output aperture located at one end of the housing, circulated through a radiator or heat exchanger and returned to an inlet aperture in the opposite end of the housing. The returned cooled fluid flows axially through the housing toward the outlet aperture, absorbing heat from the x-ray tube.

The x-ray tubes in CT scanners arc from time to time. The arcing changes the x-ray tube current, hence the x-ray output. Generally, the occurrence of arcing causes a CT scan to be discarded and retaken. In more extreme instances, the electronic circuitry that monitors the tube shuts it off. On restart, the tube functions normally again. As tubes age, the arcing normally becomes more frequent.

SUMMARY OF THE INVENTION

From time to time, bubbles form in the oil in the x-ray tube housing. These bubbles may be from small amounts of air entering the closed system through small leaks in the x-ray tube housing or its associated heat exchanger system, from the breakdown of oil due to arcing through the oil to ground, or from x-ray exposure. Because the air bubbles have a lower dielectric strength than the oil, they facilitate further arcing through the oil. Although every effort is made to minimize and remove air during construction and assembly, the bubbles frequently appear and increase over the service life of the x-ray tube.

Bubbles which form in the oil in the housing tend to migrate with the flow of oil through the tube housing, typically toward the cathode end. A suction assembly is appropriately positioned to remove bubbles with the hot oil. Preferably, the suction tube or assembly has an inlet aperture disposed in a region within the tube housing that favors bubble migration. For example, because bubbles rise by gravity in the oil, the highest point or horn of the x-ray tube is an ideal region within which to collect bubbles. Even in CT scanners in the which the x-ray tube is rotated, the top of the horn region is up when the x-ray tube is adjacent the top of the scan circle such that gravity assists bubbles into this region. The bubbles in the horn region are then captured by the judicious placement of the inlet aperture of the suction assembly.

Upon removal of the bubble from the x-ray tube housing, the bubbles are eliminated. The gaseous constituent may be trapped or withdrawn from the oil in a bubble trap or debubbler. Alternately, the gaseous component may be redissolved in the oil and recirculated.

In the preferred embodiment, the cooling fluid outlet is positioned at the upper most region of one of the horns such that any bubbles are rapidly sucked out of the horn. In this manner, bubbles are removed from the x-ray tube housing before they can ionize and cause spitting, sputtering, or arcing.

In accordance with a more limited aspect of the present invention, the outlet aperture is placed adjacent the top of the horn which houses the cathode termination assembly.

In accordance with another more limited aspect of the present invention, bubbles withdrawn from the horn are conveyed to the heat exchanger and a debubbler which removes the bubbles from the fluid.

One advantage of the present invention is that it produces a more uniform output from high power x-ray tubes.

Another advantage of the present invention is that it is simple and cost effective.

Still further advantages will become apparent to those of ordinary skill in the art upon reading and understanding the following detailed description of the preferred embodiments.

BRIEF DESCRIPTION OF THE DRAWINGS

The invention may take form in various parts and arrangements of parts and in various steps and arrangements of steps. The drawings are only for purposes of illustrating a preferred embodiment and are not to be construed as limiting the invention.

DETAILED DESCRIPTION OF THE PREFERRED EMBODIMENT

Figure 1:
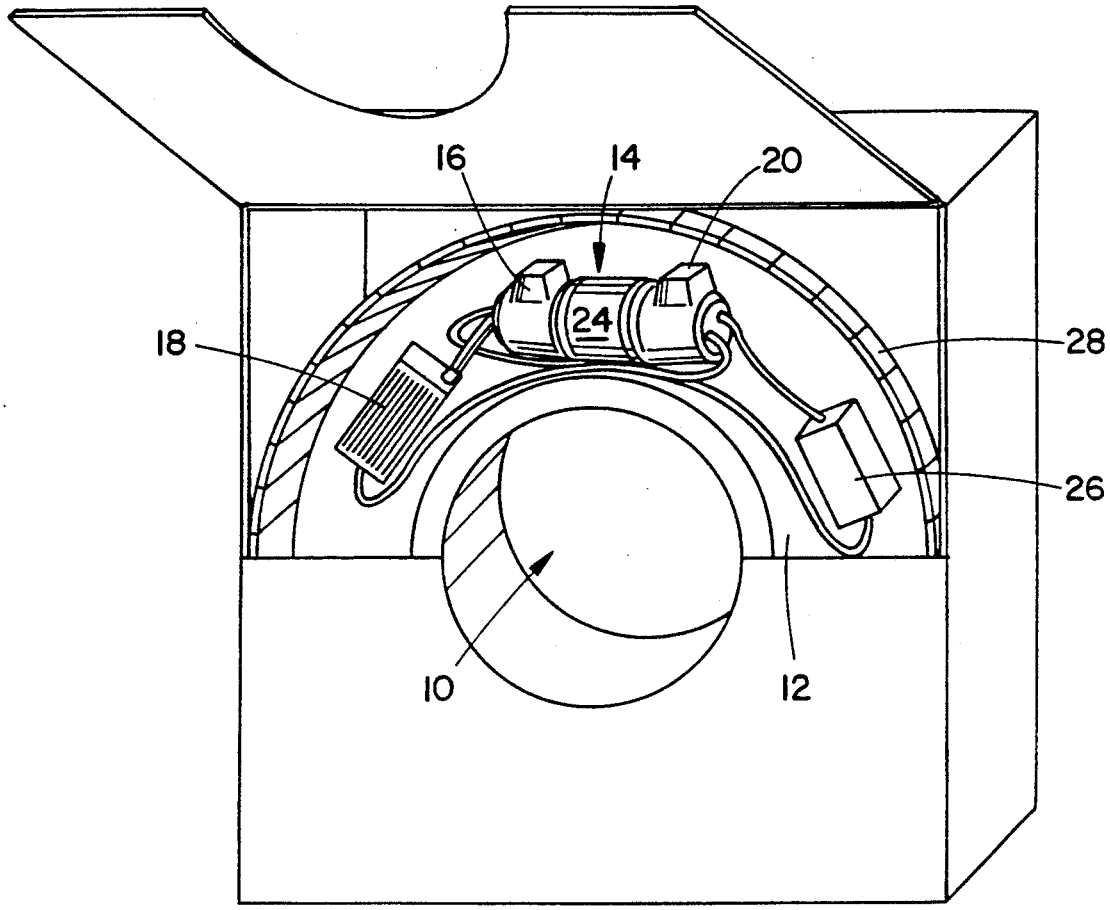
FIG. 1 is a diagrammatic illustration of a CT scanner incorporating the present invention.

A CT scanner defines a stationary patient receiving region 10. A gantry 12 is mounted for rotation around the patient receiving region. An x-ray tube 14 which projects a fan shaped beam of radiation through an x-ray window or x-ray port 15 across the patient receiving region is mounted to the gantry for rotation therewith. Coolant oil or other fluid is circulated from adjacent an upper most portion of a cathode end horn or enlarged portion 16 of the x-ray tube to a radiator or heat exchanger 18 that is also mounted on the rotating gantry. Cooled oil from the heat exchanger is returned to an anode end horn or enlarged portion 20. The cooling fluid flows from the anode horn through a cooling fluid path 22 in a central portion 24 of the x-ray tube to remove heat created during x-ray generation and into the cathode horn 16. Other equipment associated with the x-ray tube, such as a high voltage power supply 26, are also mounted on the gantry. An arc or ring of radiation detectors 28 surrounds the patient receiving region 10 such that the fan shaped beam of radiation traverses the patient receiving region and impinges upon an arc of the radiation detectors. Alternately, a short arc of radiation detectors, commensurate with the span of the fan beam, may be mounted to rotate with the gantry.

The high voltage power supply provides power to cathode and anode cables. The cathode cable connects with a cathode termination assembly within the cathode horn 16 and the anode cable is connected with an anode termination assembly within the anode horn 20. The termination assemblies are cooled with the coolant oil or other fluid that is circulated through the x-ray tube to transfer excess heat to the heat exchanger 18.

Figures 2, 3:
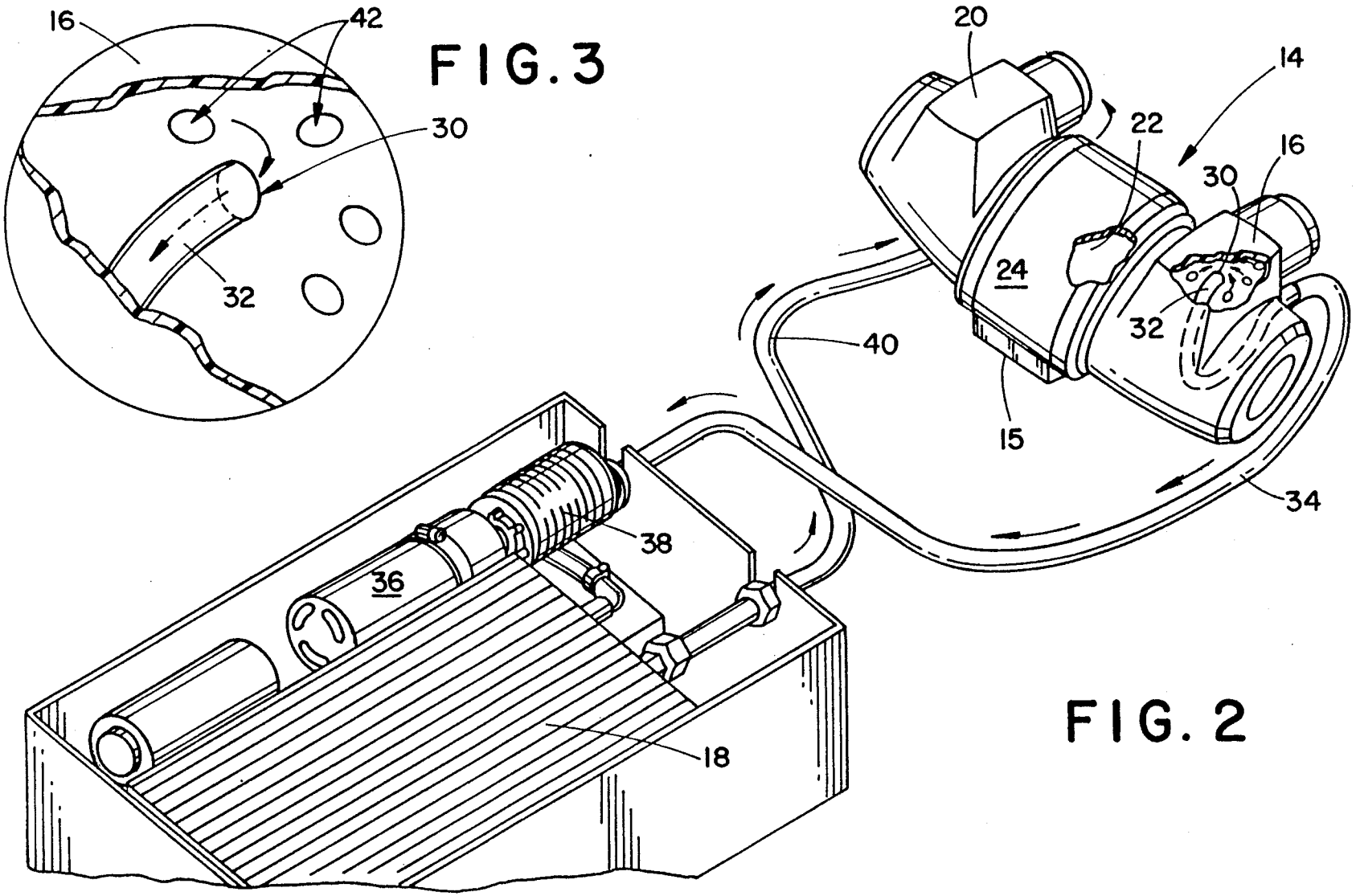
FIG. 2 is a detailed illustration of the x-ray tube and cooling fluid handling system of the scanner of FIG. 1.
FIG. 3 is an enlarged detail view of the suction tube inlet of FIG. 2.

With references to FIGS. 2 and 3, the coolant fluid assembly includes a cooling fluid receiving or suction aperture 30 defined at an upper end of an extension tube 32. The cooling fluid receiving aperture is disposed adjacent an upper most portion of the cathode horn 16. The extension tube is connected at a horn outlet with a suction line 34 that carries the coolant oil to a pump 36. The pump moves the hot coolant fluid through the heat exchanger 18 and a debubbler 38. The cooled and debubbled coolant oil is returned by a return line 40 to the anode horn 20. In a CT scanner in which the x-ray tube rotates, the upper portion or highest end of the horn is dependent upon the rotational position of the x-ray tube. In the illustrated embodiment, the receiving aperture 30 is at the top of the cathode horn when the x-ray tube 14 is at the top of the scan circle. Because the fluid receiving aperture is disposed near a corner of the horn, it is disposed at the highest point during a small but significant arc segment of the 360° of x-ray tube rotation. Preferably, the rest position of the x-ray tube between scans is within the small arc segment adjacent the top of the scan circle such that the oil is also drawn from the highest point when the tube is at rest. In the illustrated embodiment, the fluid receiving aperture 30 is disposed at the extreme opposite surface from the x-ray port 15.

The debubbler 38 removes bubbles 42 of air and other gases that are carried in the coolant fluid. The coolant oil has a wide range of hydrocarbon components. Hydrocarbon chains tend to break under the exposure to high intensity x-rays and from the high heat. This breaking of the hydrocarbon chains releases more volatile, gaseous hydrocarbons which form bubbles.

Figure 4:
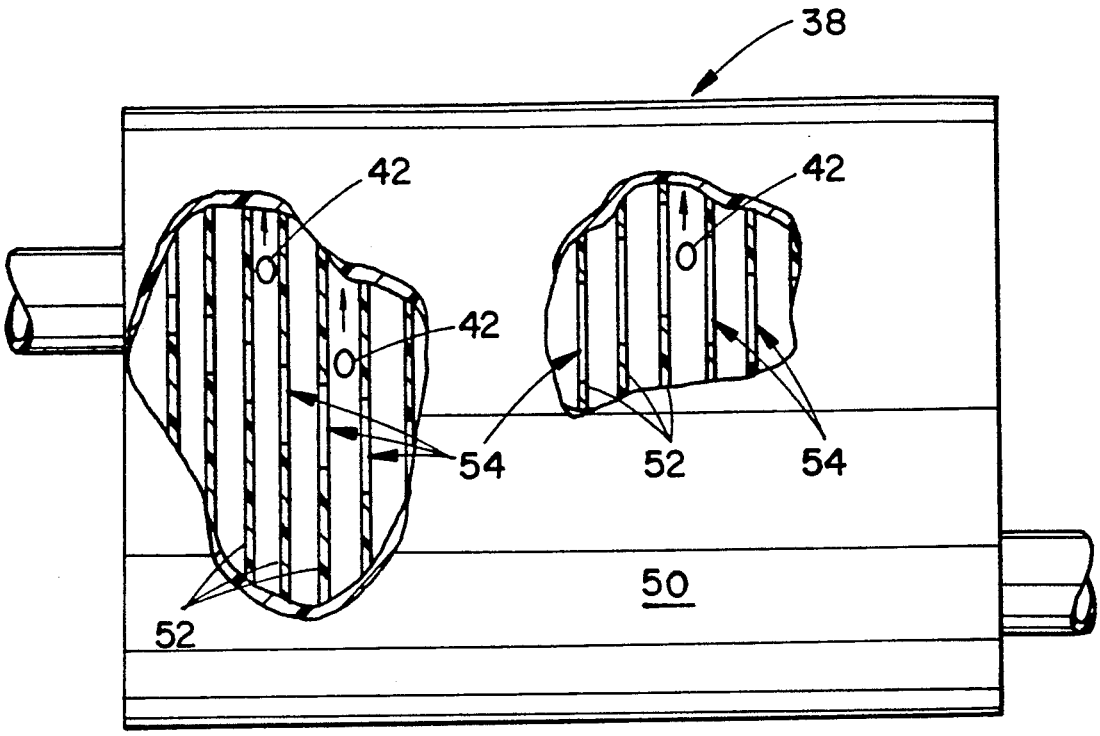
FIG. 4 is a side view in partial section of the bubble trap of FIG. 1.
Figure 5:
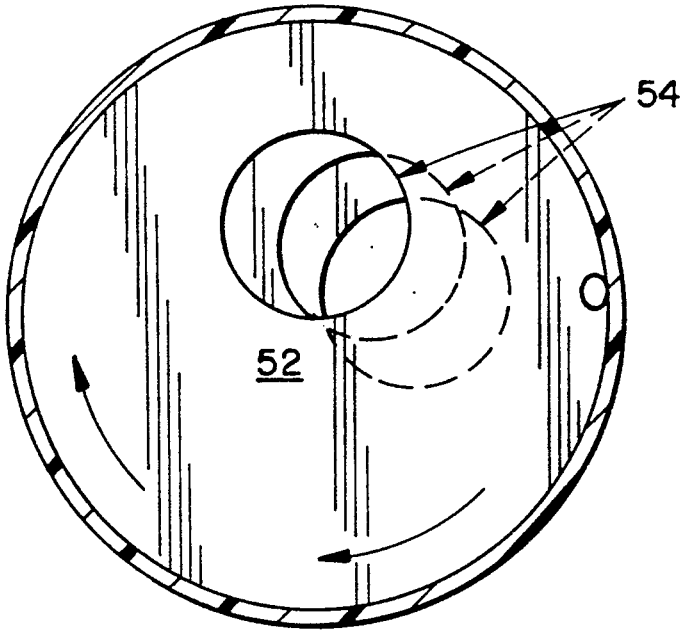
FIG. 5 is a transverse sectional view of the bubble trap of FIG. 1 taken between disks with apertures of the next two succeeding disks illustrated partially in phantom; and, FIG. 6 is an enlarged view of an alternate embodiment of a cooling fluid intake assembly in accordance with the present invention.

With reference to FIGS. 4 and 5, the debubbler 38 in the preferred embodiment includes a tubular, cylindrical casing 50. A plurality of divider disks 52 are mounted at close intervals transversely across the cylindrical casing to divide it into a large multiplicity of compartments therebetween. Each divider wall 52 has an aperture 54 offset from the geometric center. The divider walls are rotationally offset from each other such that the apertures 54 are arranged in a spiral path around a central axis of the canister and the cylindrical outer wall 50. This causes the oil and any entrapped air bubbles to take a like spiral path as it travels through the debubbler canister from divider to divider. The spiral motion of the entrapped bubble results in the bubble being displaced toward the center of the cartridge where the bubble floats into the less turbulent region between dividers and rises to the top surface. Because the oil is stagnant, i.e. essentially zero flow, in the regions away from the spiral flow the bubbles remain trapped at the top of the zones between the partitions.

Alternately, other debubbler means may be provided which remove gas bubbles or the volatile hydrocarbons which form bubbles under at least some of the temperature and pressure conditions encountered in the cooling system of the x-ray tube. These other debubbling means may be mechanical, physical, chemical, electrical, or the like.

Figure 6:
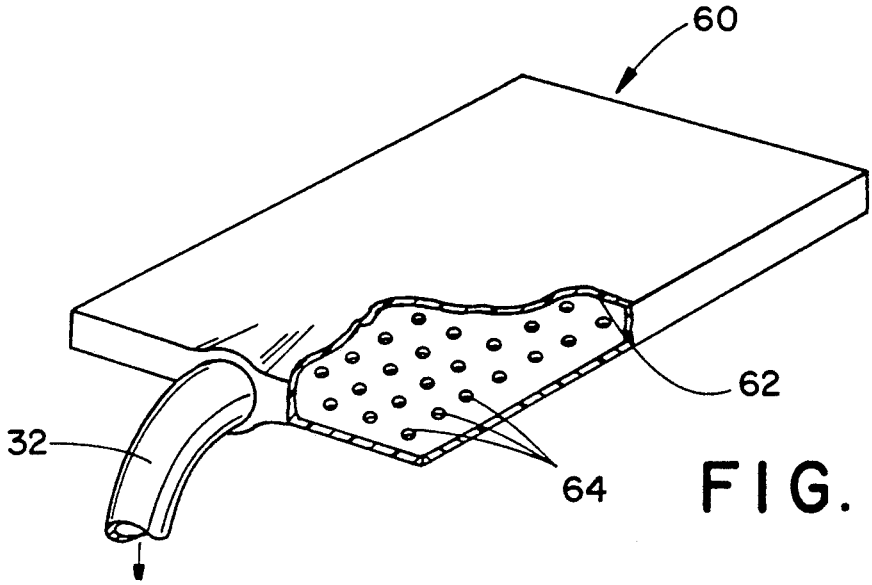

The cooling fluid receiving aperture 30 may merely be a circular opening positioned near the top of the horn, or preferably, is designed to sweep bubbles clear from the uppermost region of the horn. In the embodiment of FIG. 6, the extension suction tube 32 is connected with a fitting 60 which is dimensioned to conform substantially to the uppermost surface of the horn. The fitting has upper and lower surfaces which define a thin hollow passage 62. The upper fitting surface may be the top wall of the horn. A plurality of apertures 64 in a lower surface draw cooling fluid, hence any rising bubbles, from across the entire upper surface of the horn. Other intake designs are also contemplated. One or more fittings may be connected to the end of the suction tube to create selected coolant fluid flow patterns. For example, a sheet or layer of cooling fluid can be drawn across the upper most surface of the horn and into the suction tube 32 by a flared fitting. Other fittings can also sweep the upper most surface of the horn clear of bubbles. As another alternative, the suction side may be placed in the anode horn.

The invention has been described with reference to the preferred embodiments. Obviously, modifications and alterations will occur to others upon reading and understanding the preceding detailed description. It is intended that the invention be construed as including all such alterations and modifications insofar as they come within the scope of the appended claims or the equivalents thereof.

Having thus described the preferred embodiment, the invention is now claimed to be:

1. A method of reducing x-ray output fluctuations from an x-ray tube, which fluctuations are attributable to an ionization of gas bubbles in cooling fluid adjacent a cathode termination assembly, the method comprising:

allowing bubbles to rise to an uppermost portion of a cooling fluid reservoir around the cathode termination assembly;

drawing cooling fluid from the upper most portion of the reservoir such that any bubbles in the cooling fluid are drawn off;

cooling the fluid and removing bubbles before returning the fluid to the x-ray tube.

2. An x-ray tube housing assembly comprising:

a central x-ray tube portion that houses an x-ray tube, the central x-ray tube portion having a window for transmitting x-rays generated by the x-ray tube and at least one cooling fluid conducting path axially therethrough;

an anode termination assembly to which an anode power supply is connected adjacent a first end of the central portion;

a first enlarged horn portion connected to the central portion first end surrounding the anode termination assembly and defining a cooling fluid receiving reservoir therein in fluid communication with the at least one axial path through the central tube portion;

a cathode termination assembly connected with a second end of the central portion;

a second enlarged horn portion connected to the central portion second end surrounding the cathode termination assembly for defining a cooling fluid reservoir therein in fluid communication with the at least one axial path through the central tube portion;

a cooling fluid receiving aperture through which hot cooling fluid is withdrawn the aperture being disposed closely adjacent an upper most portion of the second enlarged horn portion; and an extension tube extending through the second enlarged horn portion from the cooling fluid receiving aperture to a fluid cooling means;

a means for returning cooled cooling fluid to the first enlarged horn portion.

3. An x-ray tube housing assembly comprising:

a central x-ray tube portion that houses an x-ray tube, the central x-ray tube portion having a window for transmitting x-rays generated by the x-ray tube and at least one cooling fluid conducting path axially therethrough;

a first enlarged horn portion connected to a central portion first end for defining a cooling fluid receiving reservoir therein in fluid communication with the at least one axial path through the central tube portion;

an anode termination assembly mounted in the first enlarged horn position;

a second enlarged horn portion connected to a central portion second end for defining a cooling fluid reservoir therein in fluid communication with the at least one axial path through the central tube portion;

a cathode termination assembly mounted in the second enlarged horn portion;

a plurality of cooling fluid receiving apertures distributed over a lower surface of a chamber which is disposed at the upper most portion of the second enlarged horn portion, the chamber being connected with a means for conveying hot cooling fluid to a fluid cooling means such that bubbles are drawn through the plurality of apertures from the second enlarged horn portion; and, a means for returning cooled cooling fluid to the first enlarged horn portion.

4. A CT scanner comprising:

an x-ray tube housing assembly mounted on a rotating gantry portion, the x-ray tube housing assembly including an x-ray window, a cathode termination assembly, an anode termination assembly, and a cooling fluid reservoir which surrounds the termination assemblies;

a heat exchanger mounted to the rotating gantry assembly;

a suction line connected at one end with a hot cooling fluid receiving aperture adjacent an upper most portion of the reservoir adjacent one of the termination assemblies and connected adjacent its other end with the heat exchanger;

a cooling fluid return line extending from the heat exchanger to the reservoir adjacent the other of the termination assemblies;

a debubbler means for removing gas from the cooling fluid; and, a pump means for circulating the cooling fluid through the heat exchanger, the suction and return lines, the debubbler means, and the x-ray tube housing assembly.

5. The CT scanner as set forth in claim 4 wherein the cooling fluid receiving aperture is disposed at a highest point of the reservoir above the cathode termination assembly.

6. The CT scanner as set forth in claim 4 further including a plurality of cooling fluid receiving apertures arranged along an upper most surface of the reservoir and connected by a fluid channel with the suction line.

7. The CT scanner as set forth in claim 4 further including an extension tube extending through the reservoir from the suction line to the cooling fluid receiving aperture at the upper most portion, adjacent the cathode termination assembly.

8. The CT scanner as set forth in claim 7 further including a fitting connected with the extension tube and defining the fluid receiving aperture, the fitting being configured to cause cooling fluid from across an upper most portion of the reservoir to be drawn into the fluid receiving aperture and the extension tube.

9. The CT scanner as set forth in claim 4 wherein the debubbler means includes:

an outer generally tubular wall;

a plurality of dividers disposed generally transversely across the tubular wall, each of the dividers defining an aperture therethrough, the dividers being spaced to define narrow regions of substantially stagnant cooling fluid therebetween such that as fluid flows through the divider apertures, bubbles rise in the partitions between the dividers and become lodged in the static fluid.

10. The CT scanner as set forth in claim 9 wherein the apertures are arranged in generally a spiral pattern around a central axis of the generally tubular outer wall.

11. In an x-ray tube in which an enlarged horn portion is defined around an electrical termination assembly, the improvement comprising:

drawing cooling fluid from a portion of the enlarged horn assembly at which bubbles tend to collect and circulating the fluid through a heat exchanger and debubbler such that any bubbles in the cooling fluid are drawn away from the electrical termination assembly to eliminate quiescent tube current irregularities attributable to ionized bubbles adjacent the electrical termination assembly.

12. The x-ray tube as set forth in claim 11 wherein the improvement further comprises:

spiraling the fluid through apertures in a plurality of dividers disposed generally transversely to a direction of fluid travel, the dividers being spaced to define narrow regions of substantially stagnant cooling fluid therebetween such that as fluid flows through the divider apertures, bubbles rise in the partitions between the dividers and become lodged in the static fluid.

13. A method of generating x-rays, the method comprising:

supplying power to anode and cathode connection assemblies to cause x-rays to be emitted from an x-ray tube through an x-ray window;

circulating a cooling fluid adjacent the cathode and anode connection assemblies and the x-ray tube and temporarily retaining the cooling fluid in a reservoir surrounding at least one of the anode and cathode termination assemblies;

withdrawing the cooling fluid from the reservoir at a location which optimizes removal of bubbles from the reservoir with the cooling fluid;

after withdrawing the cooling fluid from the reservoir, trapping any withdrawn bubbles and holding such bubbles in a bubble trap;

cooling the cooling fluid and recirculating the cooling fluid adjacent the anode and cathode termination assemblies and the anode.

14. An x-ray tube assembly comprising:

a central x-ray tube portion having a window for transmitting generated x-rays and a cooling fluid conducting path therethrough;

anode and cathode termination assemblies to which anode and cathode power supplies are connected, the anode and cathode termination assemblies being disposed adjacent the central x-ray tube portion;

at least one enlarged portion connected with the central portion surrounding one of the anode and cathode termination assemblies and defining a cooling fluid receiving reservoir therein, the cooling fluid receiving reservoir being in fluid communication with the cooling fluid path through the central portion;

a heat exchanger suction tube having an inlet aperture disposed in one of the cooling fluid receiving reservoir and the cooling fluid conducting path in a location which favors removal of bubbles from the x-ray tube;

a bubble trap for holding bubbles removed from the x-ray tube by the suction tube, which bubbles do not readily dissolve in the cooling fluid.

15. The x-ray tube assembly as set forth in claim 14 wherein the bubble trap includes:

an outer generally tubular wall;

a plurality of dividers disposed generally transversely across the tubular wall, each of the dividers defining an aperture therethrough, the dividers being spaced to define narrow regions of substantially stagnant cooling fluid therebetween such that as fluid flows through the divider apertures, bubbles rise in the partitions between the dividers and become lodged in the static fluid.

16. The x-ray tube assembly as set forth in claim 15 wherein in the bubble trap, the apertures are arranged in generally a spiral pattern around a central axis.

* * * * *